US010845035B1

(12) United States Patent
Li

(10) Patent No.: US 10,845,035 B1
(45) Date of Patent: Nov. 24, 2020

(54) DETACHABLY ASSEMBLED AND INDEPENDENTLY USED LED MOTHER-SON LAMP

(71) Applicant: DongGuan City General Success Industrial Co. LTD, DongGuan (CN)

(72) Inventor: Ming Li, GuangDong (CN)

(73) Assignee: DongGuan City General Success Industrial Co. Ltd., Dongguan (CN)

( * ) Notice: Subject to any disclaimer, the term of this patent is extended or adjusted under 35 U.S.C. 154(b) by 0 days.

(21) Appl. No.: 16/572,633

(22) Filed: Sep. 17, 2019

(30) Foreign Application Priority Data

Aug. 1, 2019 (CN) ..... 2019 1 0705429

(51) Int. Cl.
*F21V 19/00* (2006.01)
*F21V 21/096* (2006.01)
*F21Y 115/10* (2016.01)

(52) U.S. Cl.
CPC ..... *F21V 19/0015* (2013.01); *F21V 21/096* (2013.01); *F21Y 2115/10* (2016.08)

(58) Field of Classification Search
None
See application file for complete search history.

(56) References Cited

U.S. PATENT DOCUMENTS 10,274,149 B2 * 4/2019 Workman ..... F21V 7/28
2014/0177210 A1 * 6/2014 Sharrah ..... F21L 19/00 362/158
2019/0215926 A1 * 7/2019 Lay ..... F21V 23/0464

* cited by examiner

*Primary Examiner* — Britt D Hanley
(74) *Attorney, Agent, or Firm* — Karin L. Williams; Alan D. Kamrath; Mayer & Williams PC

(57) ABSTRACT

An LED mother-son lamp includes a mother lamp body and a son lamp body. The mother lamp body includes a mother lamp bracket a mother lamp head, and a mother lamp cover mounted on the mother lamp bracket. The interior of the mother lamp cover forms a receiving chamber for accommodating the son lamp body and having an opening downward. A positioning seat for pairing and mounting the son lamp body is provided on the mother lamp head. The son lamp body includes a son lamp bracket, a son lamp head and a son lamp cover mounted on the son lamp bracket. The son lamp head is located in the son lamp cover. The top of the son lamp bracket is provided with a quick mounting seat for detachable mounting with the positioning seat.

9 Claims, 11 Drawing Sheets

DETACHABLY ASSEMBLED AND INDEPENDENTLY USED LED MOTHER-SON LAMP

TECHNICAL FIELD

The present invention relates to the field of lighting fixtures, in particular to a detachably assembled and independently used LED mother-son lamp.

BACKGROUND OF THE INVENTION

Traditional luminaires have a single function, and different uses require different luminaires. Different luminaires can be divided into home lights, emergency lights, outdoor lights, etc. according to different places of use. Due to the different structures of the respective luminaires, they need to be configured independently. On the one hand, different structures increase the cost, and there are shortcomings such as a waste of resources and low flexibility of use. In addition, different structures will occupy more living space and affect the living environment.

SUMMARY OF THE INVENTION

The objective of the present invention is to solve the above-described drawbacks of traditional luminaries, and to provide a detachably assembled and independently used LED mother-son lamp, which is easy to disassemble and assemble, and can be used as an independent luminaire after disassembly.

The primary objective of the present invention is to provide an LED mother-son lamp which is connected and removed easily. To obtain above-mentioned objective, an LED mother-son lamp provided by the present invention contains a mother lamp body and a son lamp body.

The mother lamp body includes a mother lamp bracket, a mother lamp head, and a mother lamp cover mounted on the mother lamp bracket.

A downward LED mother lamp light source is mounted on the mother lamp head, and a power cord for supplying power to the LED mother lamp light source is connected to the mother lamp head.

The mother lamp cover is mounted at a bottom of the mother lamp bracket, and the mother lamp cover extends downward form a hollow cylindrical structure, the mother lamp head is located in the mother lamp cover; an interior of the mother lamp cover forms a receiving chamber for accommodating the son lamp body and having an opening.

A positioning seat for pairing and mounting the son lamp body is provided on the mother lamp head.

The son lamp body includes a son lamp bracket, a son lamp head, and a son lamp cover mounted on the son lamp bracket, wherein the son lamp bracket is a cylindrical frame structure, and a diameter of the son lamp bracket is less than an inner diameter of the mother lamp cover.

The son lamp head is provided at a lower end of the son lamp bracket, and an upward LED son lamp light source is mounted on the son lamp head.

A battery pack for supplying power to the LED son lamp light source is provided at a bottom of the son lamp bracket.

The son lamp cover is provided in the son lamp bracket and extends upward to an upper end of the son lamp bracket along the son lamp head; and The son lamp head is located in the son lamp cover, and a top of the son lamp bracket is provided with a quick mounting seat for removing from the positioning seat.

Figure 1:
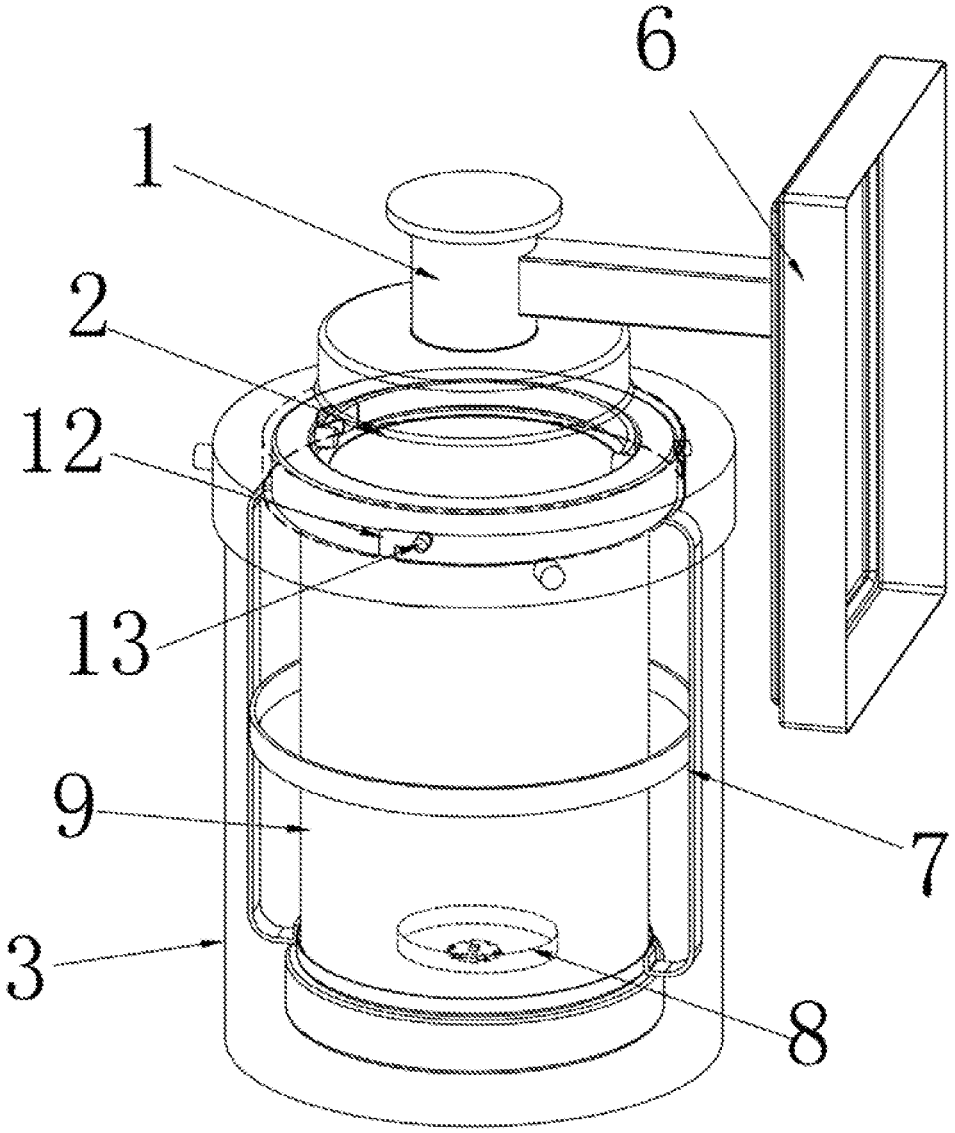
FIG. 1 shows a schematic diagram of the assembly state of the mother lamp body and the son lamp body in Example 1 of the present invention.

The upward arrow in the figure indicates the upward mounting direction of the son lamp body. Reference numeral 1 represents the mother lamp bracket, 2 represents the mother lamp head, 3 represents the mother lamp cover, 4 represents the LED mother lamp light source, 5 represents the LED mother lamp light source, 6 represents the positioning bracket, 7 represents the son lamp bracket, 8 represents the LED son lamp light source, 9 represents the son lamp cover, 10 represents the handle, 11 represents the circular positioning tube, 12 represents the L-shaped groove, 13 represents the post, 14 represents the inner threaded socket, 15 represents the external threaded rod, 16 represents the ring-shaped upper magnet, 17 represents the ring-shaped lower magnet, 18 represents the circular sheath, 19 represents the hanging hole, 20 represents the V-shaped hook, 21 represents the torsion spring, 22 represents the pressing post, 23 represents the return spring, 24 represents the track, 25 represents the positioning post, 26 represents the pressing spring, and 27 represents the limit slider.

DETAILED DESCRIPTION OF EMBODIMENTS

The present invention will be further described in detail below in conjunction with the drawings and specific embodiments.

Example 1

Figure 2:
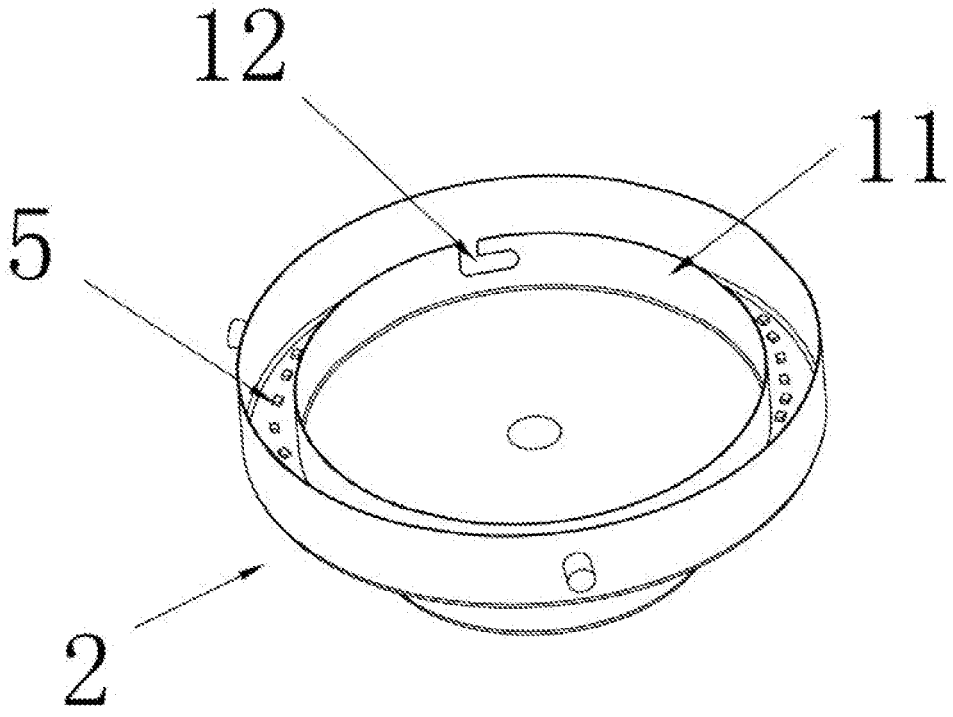
FIG. 2 shows a three-dimensional structure diagram of the mother lamp head in Example 1 of the present invention.
Figure 3:
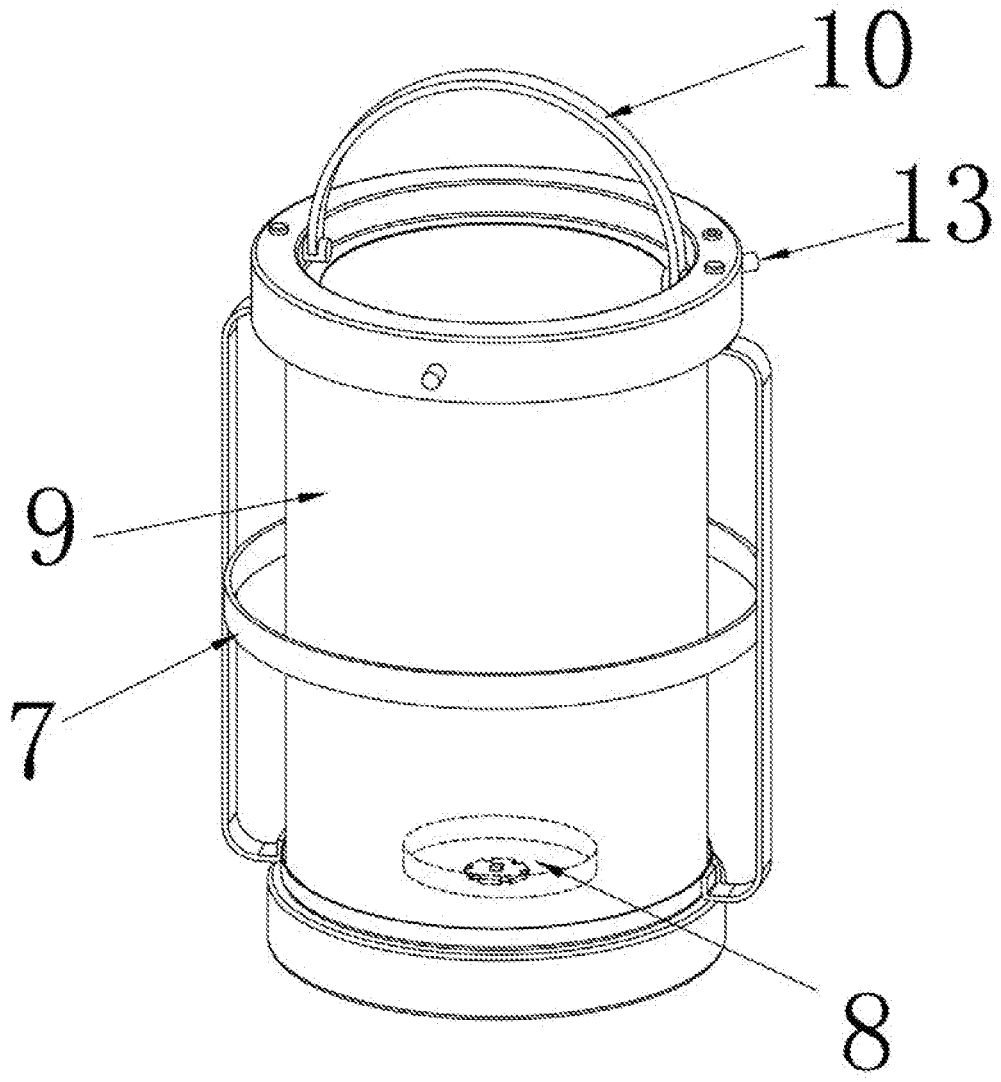
FIG. 3 shows a three-dimensional structure diagram of the son lamp head in Example 1 of the present invention.

In this example, referring to FIG. 1 to FIG. 3, the detachably assembled and independently used LED mother-son lamp implemented in this embodiment includes a mother lamp body and a son lamp body. The mother lamp body includes a mother lamp bracket 1, a mother lamp head 2 and a mother lamp cover 3 mounted on the mother lamp bracket 1. A downward LED mother lamp light source 54 is mounted on the mother lamp head 2, and the LED mother lamp light source 54 is in a circular distribution. A power cord for supplying power to the LED mother lamp light source 54 is connected to the mother lamp head 2. The mother lamp body of this example is a wall lamp. A positioning bracket 6 for fixing to the wall surface is connected to the side of the mother lamp bracket 1. The mother lamp cover 3 is made of a glass material. The mother lamp cover 3 is mounted at the bottom of the mother lamp bracket 1, and the mother lamp cover 3 extends downward to form a hollow cylindrical structure. The mother lamp head 2 is located in the mother lamp cover 3. The interior of the mother lamp cover 3 forms a receiving chamber for accommodating the son lamp body and having an opening downward.

A positioning seat for pairing and mounting the son lamp body is provided on the mother lamp head 2. The son lamp body can pass through the receiving chamber along the lower opening of the mother lamp cover 3, and is fixedly mounted by the positioning seat, so that the son lamp body and the mother lamp body are integrated into one body.

The son lamp body is composed of a son lamp bracket 7, a son lamp head and a son lamp cover 9 mounted on the son lamp bracket 7. The son lamp bracket 7 is a cylindrical frame structure. The top of the son lamp bracket 7 is mounted with a handle 10 through a pin. The diameter of the son lamp bracket 7 is less than the inner diameter of the mother lamp cover 3. The son lamp head is provided at a lower end of the son lamp bracket 7. An upward LED son lamp light source 8 is mounted on the son lamp head. A battery pack for supplying power to the LED son lamp light source 8 is provided at the bottom of the son lamp bracket 7, and a switch for controlling the operation of the LED son lamp light source 8 is additionally provided. The son lamp cover 9 is provided in the son lamp bracket 7, and extends upward along the son lamp head to the upper end of the son lamp bracket 7. The son lamp head is located in the son lamp cover 9. The top of the son lamp bracket 7 is provided with a quick mounting seat for detachable mounting with the positioning seat.

The positioning seat of this example is formed by a circular positioning tube 11 extending downward along the mother lamp head 2. Three L-shaped grooves 12 are provided on the circular positioning tube 11. The quick mounting seat is composed of a post 13 that is paired with the number and position of the L-shaped grooves 12. The post 13 is mounted laterally to the top edge of the son lamp bracket 7. The opening of the L-shaped groove 12 is downward, the post 13 is snapped up along the opening of the L-shaped groove 12, and the post 13 is clamped in the L-shaped groove 12 by rotating the son lamp bracket 7. During the operation, when it is necessary to mount the son lamp body, the son lamp body is inserted upward into the receiving chamber along the lower opening of the mother lamp cover 3, and then the positions of the post 13 and the opening of the L-shaped groove 12 are aligned, and the son lamp bracket 7 is rotated by hand to stably lock the post 13 into the L-shaped groove 12. At this time, the son lamp body will be stably fixed in the receiving chamber. When it is necessary to disassemble the son lamp body, the son lamp bracket 7 is rotated in the opposite direction by hand to disengage the post 13 from the L-shaped groove 12. At this time, the son lamp body can be taken out along the lower opening of the mother lamp cover 3. The son lamp body is powered by an independent power supply and can be used independently without affecting the normal use of the mother lamp body.

Example 2

Figure 4:
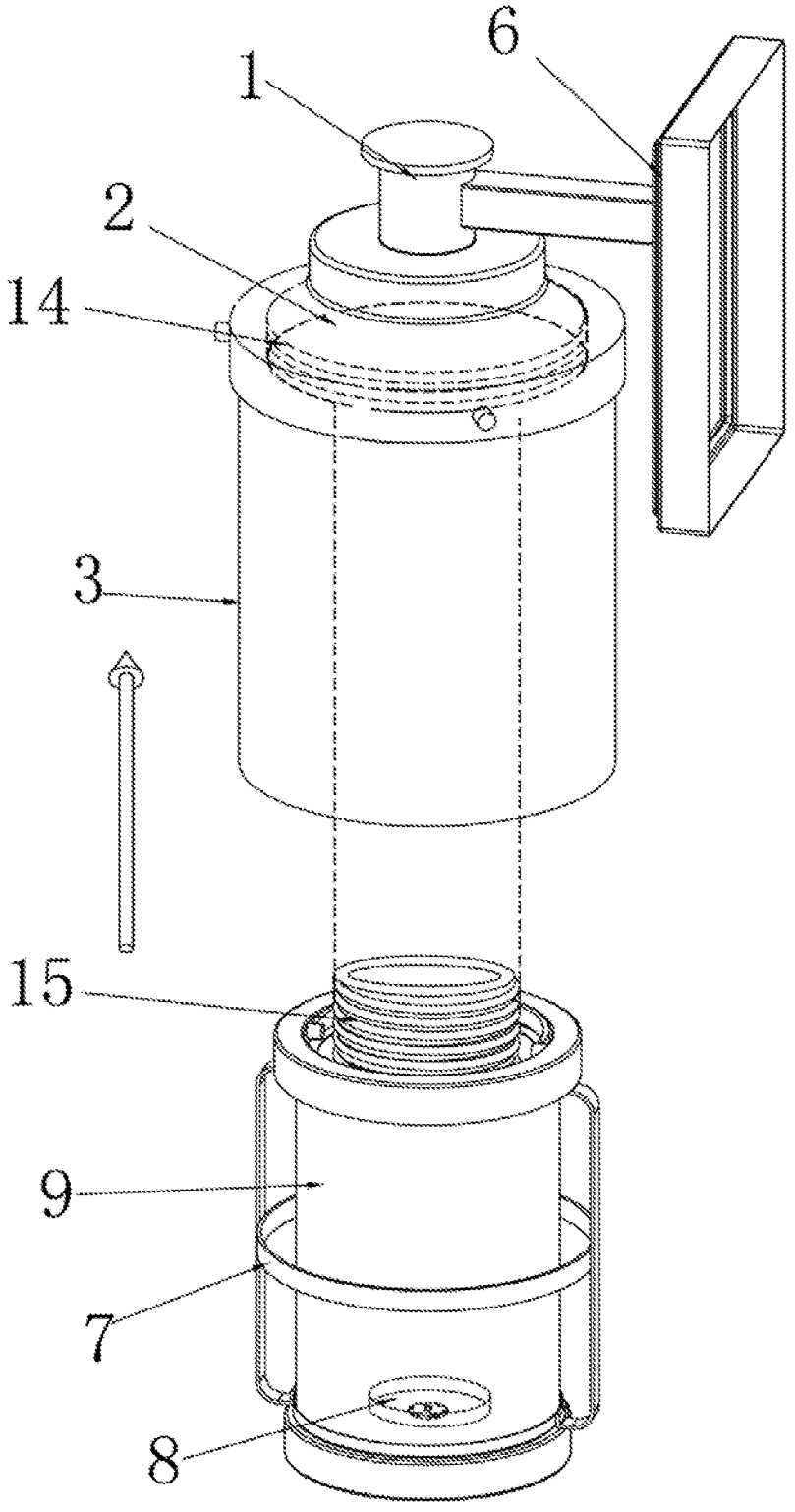
FIG. 4 shows a schematic diagram of the disassembly state of the mother lamp body and the son lamp body in Example 2 of the present invention.

In this example, referring to FIG. 4, the difference between this example and Example 1 is that the structures of the positioning seat and the quick mounting seat are different. The positioning seat of this example is composed of an inner screw seat 14 with an opening downward. The quick mounting seat is composed of an external threaded rod 15 that extends upward and is paired with the inner threaded socket 14. During the operation, when it is necessary to mount the son lamp body, the son lamp body is inserted upward into the receiving chamber along the lower opening of the mother lamp cover 3, and then the external threaded rod 15 is aligned with the inner threaded socket 14, and the son lamp bracket 7 is rotated by hand to slowly screw the external threaded rod 15 into the inner threaded socket 14. At this time, the son lamp body will be stably fixed in the receiving chamber. When it is necessary to disassemble the son lamp body, the son lamp bracket 7 is rotated in the opposite direction by hand, so that the external threaded rod 15 is slowly unscrewed from the inner threaded socket 14. At this time, the son lamp body can be taken out along the lower opening of the mother lamp cover 3. The son lamp body is powered by an independent power supply and can be used independently without affecting the normal use of the mother lamp body.

Example 3

Figure 5:
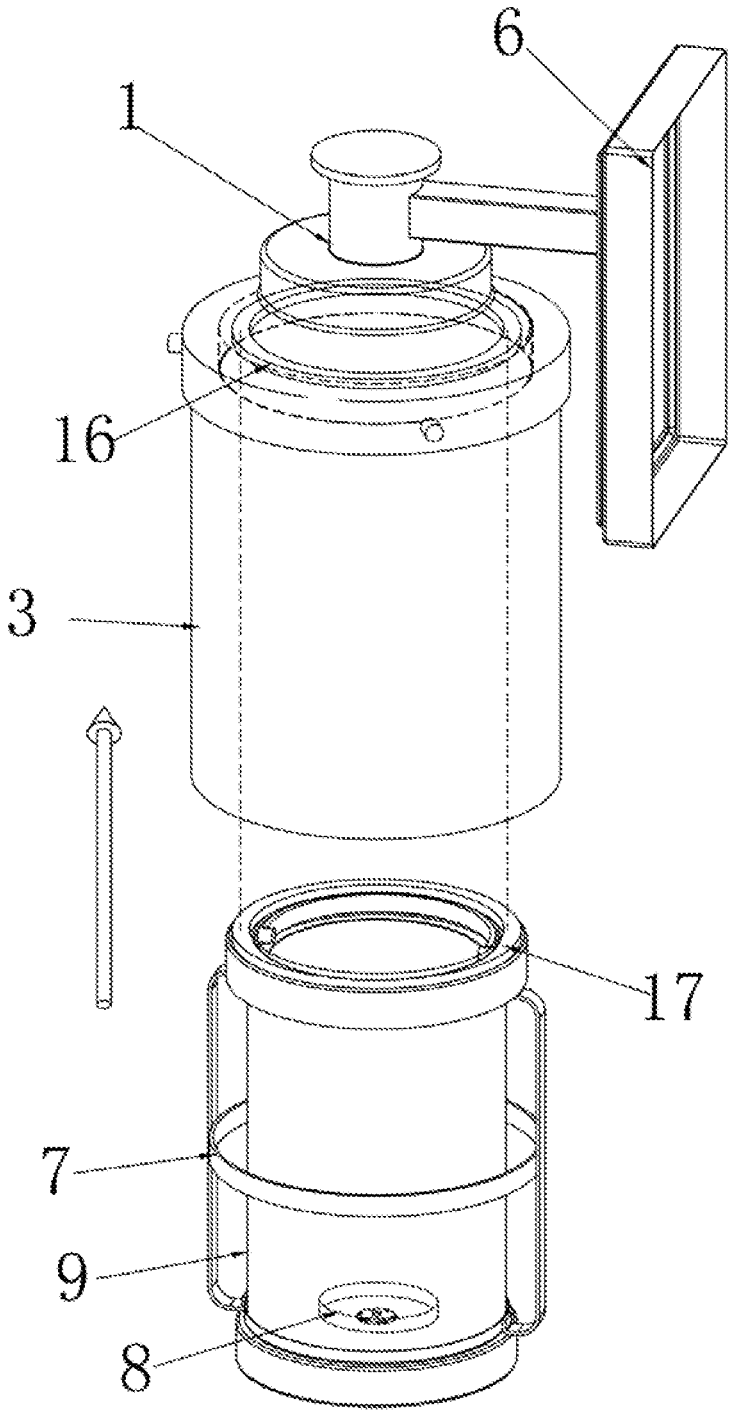
FIG. 5 shows a schematic diagram of the disassembly state of the mother lamp body and the son lamp body in Example 3 of the present invention.

In this example, referring to FIG. 5, the difference between this example and Example 1 is that the structures of the positioning seat and the quick mounting seat are different. The positioning seat of this example is formed by a ring-shaped upper magnet 16 disposed laterally. The ring-shaped upper magnet 16 is fixed to the bottom surface of the mother lamp head 2. The quick mounting seat is composed of a ring-shaped lower magnet 17 disposed laterally and magnetically fixed to the ring-shaped upper magnet 16, and the diameter of the ring-shaped lower magnet 17 is the same as that of the ring-shaped upper magnet 16. The ring-shaped lower magnet 17 is fixed to the top surface of the son lamp bracket 7. During the operation, when it is necessary to mount the son lamp body, the son lamp body is inserted upward into the receiving chamber along the lower opening of the mother lamp cover 3, and then the ring-shaped lower magnet 17 is aligned with the ring-shaped upper magnet 16, so that the ring-shaped lower magnet 17 and the ring-shaped upper magnet 16 are magnetically coupled by a magnetic force sufficient to support the entire son lamp body. At this time, the son lamp body will be stably fixed in the receiving chamber. When it is necessary to disassemble the son lamp body, the son lamp bracket 7 is directly grasped by hand and pulled downward to be pulled out along the lower opening of the mother lamp cover 3. It is easy to assemble and disassemble, and no tools are required. The son lamp body is powered by an independent power supply and can be used independently without affecting the normal use of the mother lamp body.

Example 4

Figure 6:
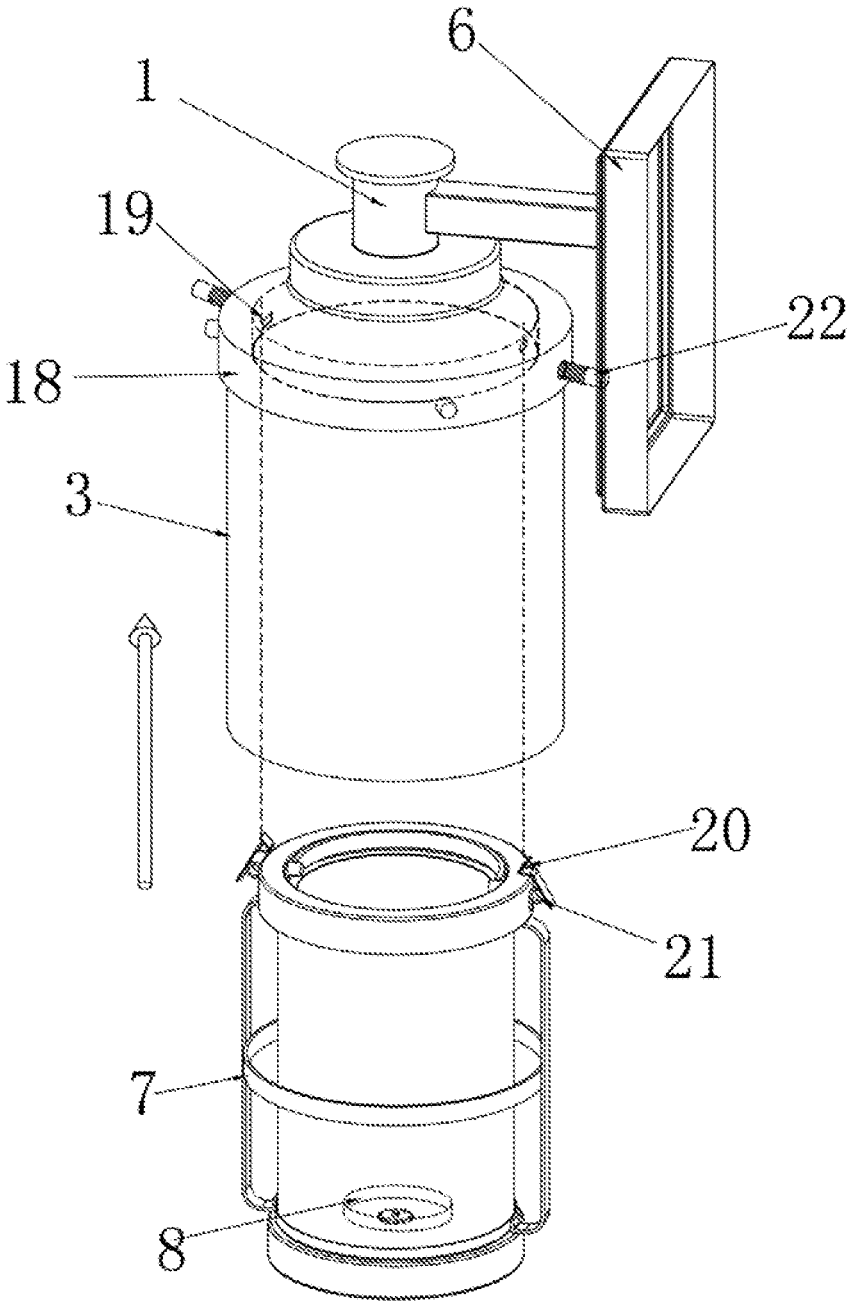
FIG. 6 shows a schematic diagram of the disassembly state of the mother lamp body and the son lamp body in Example 4 of the present invention.
Figure 7:
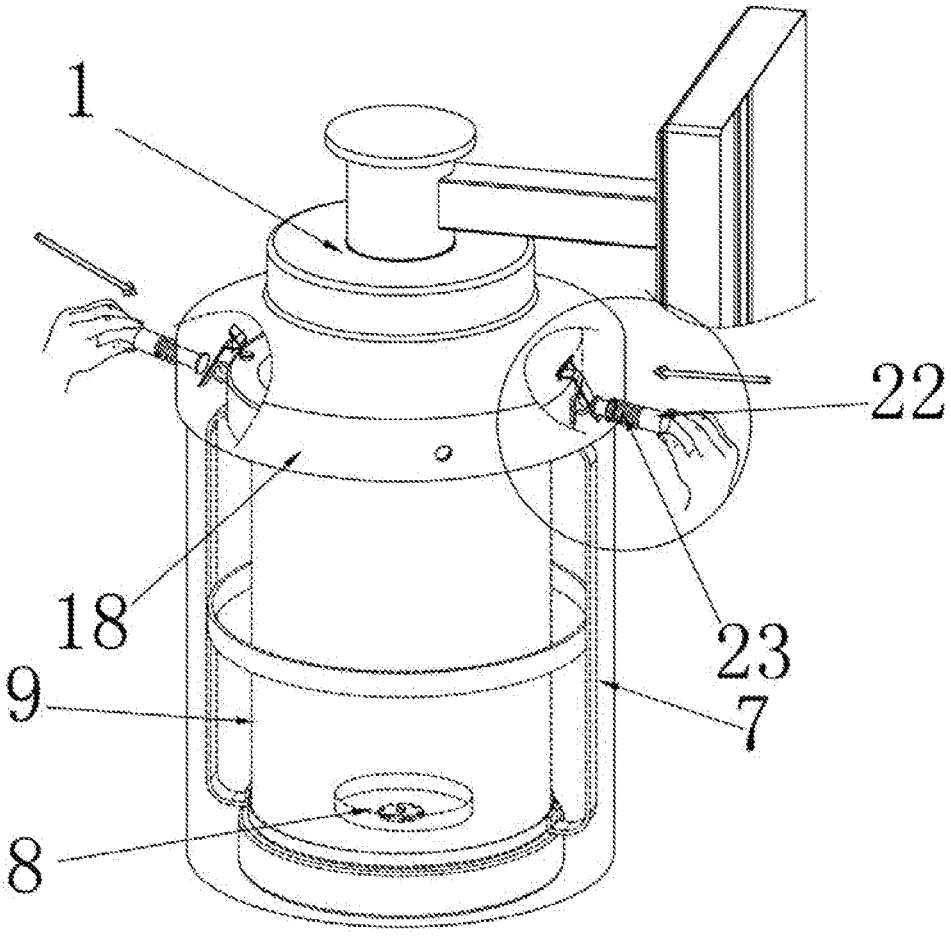
FIG. 7 shows an operation diagram of the assembly state of the mother lamp body and the son lamp body in Example 4 of the present invention.
Figure 8:
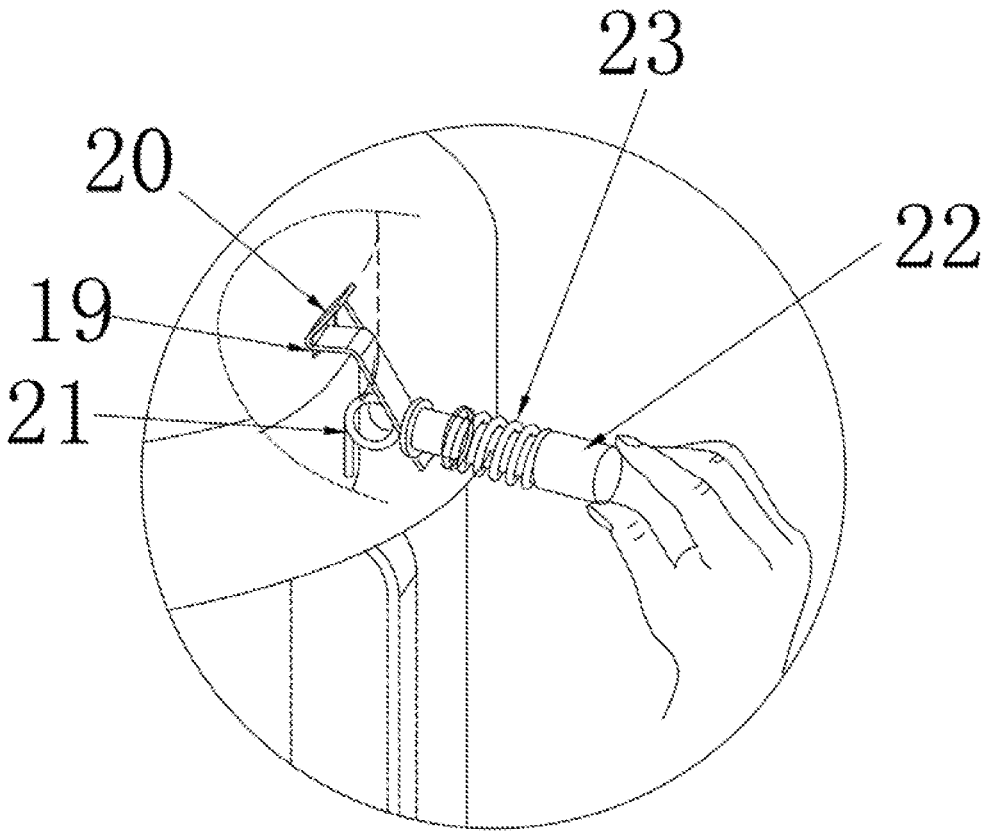
FIG. 8 shows a partial enlarged view of FIG. 7.

In this example, referring to FIG. 6, FIG. 7, and FIG. 8, the difference between this example and Example 1 is that the structures of the positioning seat and the quick mounting seat are different. The positioning seat of this example is formed by a circular positioning tube 11 extending downward along the mother lamp head 2. The bottom of the mother lamp bracket 1 forms a circular sheath 18 downward. The circular sheath 18 is located at the periphery of the circular positioning tube 11. Both sides of the circular positioning tube 11 are provided with hanging holes 19. The quick mounting seat is composed of elastic pieces disposed on both sides of the top of the son lamp bracket 7. The elastic piece is installed by a torsion spring 21. The inner end of the elastic piece is provided with a V-shaped hook 20 for pairing into the hanging hole 19, and the outer end of the elastic piece is a pressing portion. Both sides of the circular sheath 18 are provided with a pressing device corresponding to the position of the pressing portion. The outer end of the pressing device extends outwardly beyond the circular sheath 18. The pressing device is composed of a pressing post 22 and a return spring 23. The return spring 23 is fitted over the inner side of the pressing post 22, and the inner end of the return spring 23 is placed on the side of the circular sheath 18. The return spring 23 is used to reset the pressing post 22. The inner end of the pressing post 22 extends inwardly to the pressing portion. The outer end of the pressing post 22 extends outwardly to the side of the circular sheath 18, and is accessible by hand.

When it is necessary to mount the son lamp body, the son lamp body is inserted upward into the receiving chamber along the lower opening of the mother lamp cover 3, and then the V-shaped hook 20 is aligned with the hanging hole 19, and the son lamp bracket 7 is grasped by hand to continue pushing upward, so that the V-shaped hook 20 is paired into the hanging hole 19. Since the elastic piece has a good rebound resilience, so that the V-shaped hook 20 can be quickly snapped into the hanging hole 19. At this time, the son lamp body will be stably fixed in the receiving chamber. When it is necessary to disassemble the son lamp body, the outer ends of the pressing posts 22 on both sides are pressed inwardly by hand, so that the pressing portion is driven inwardly by the inner ends of the pressing posts 22. At this time, under the action of the torsion spring 21, the V-shaped hooks 20 on both sides will eject the hanging holes 19 outward and are separated from the hanging holes 19. At this time, the son lamp body can be taken out along the lower opening of the mother lamp cover 3. The son lamp body is powered by an independent power supply and can be used independently without affecting the normal use of the mother lamp body.

Example 5

Figure 9:
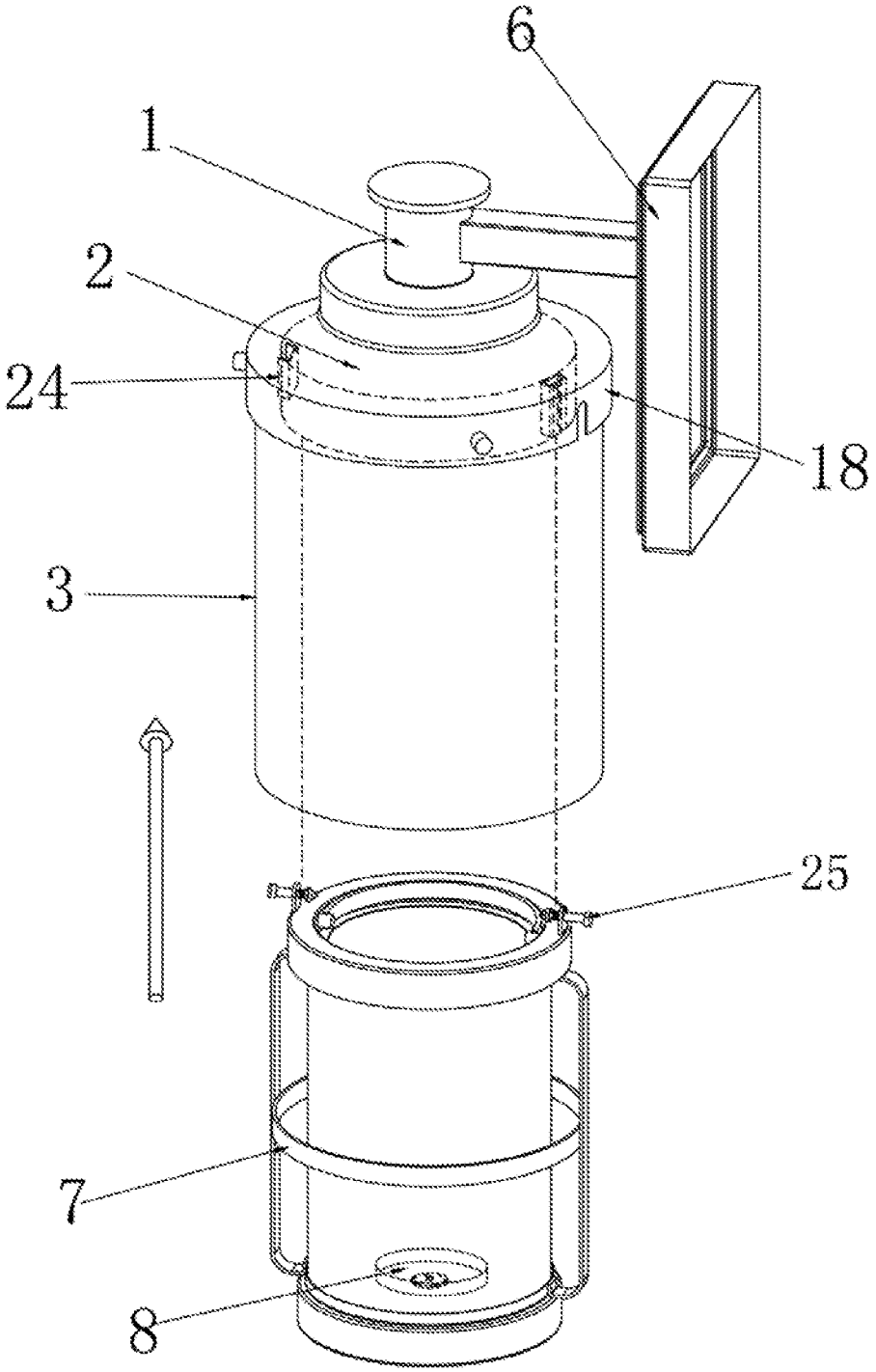
FIG. 9 shows a schematic diagram of the disassembly state of the mother lamp body and the son lamp body in Example 5 of the present invention.
Figure 10:
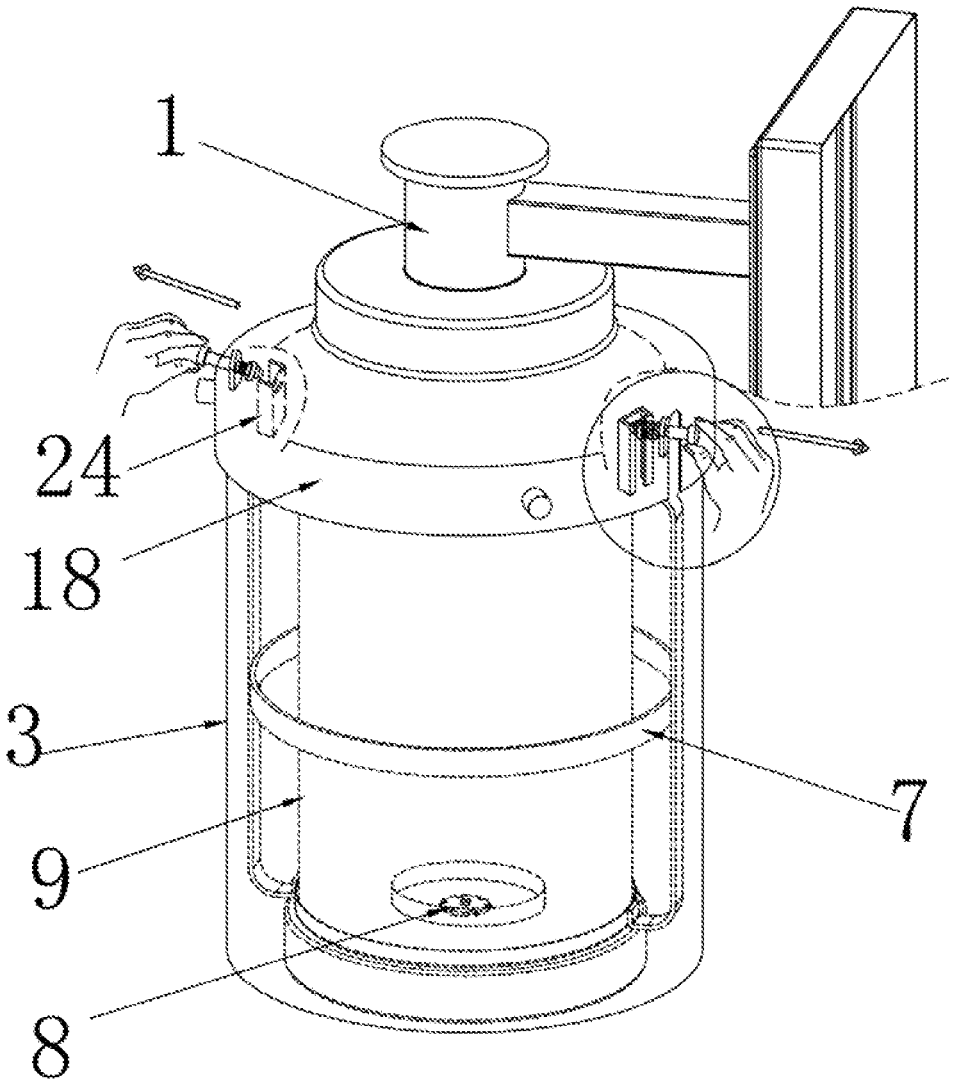
FIG. 10 shows an operation diagram of the assembly state of the mother lamp body and the son lamp body in Example 5 of the present invention.
Figure 11:
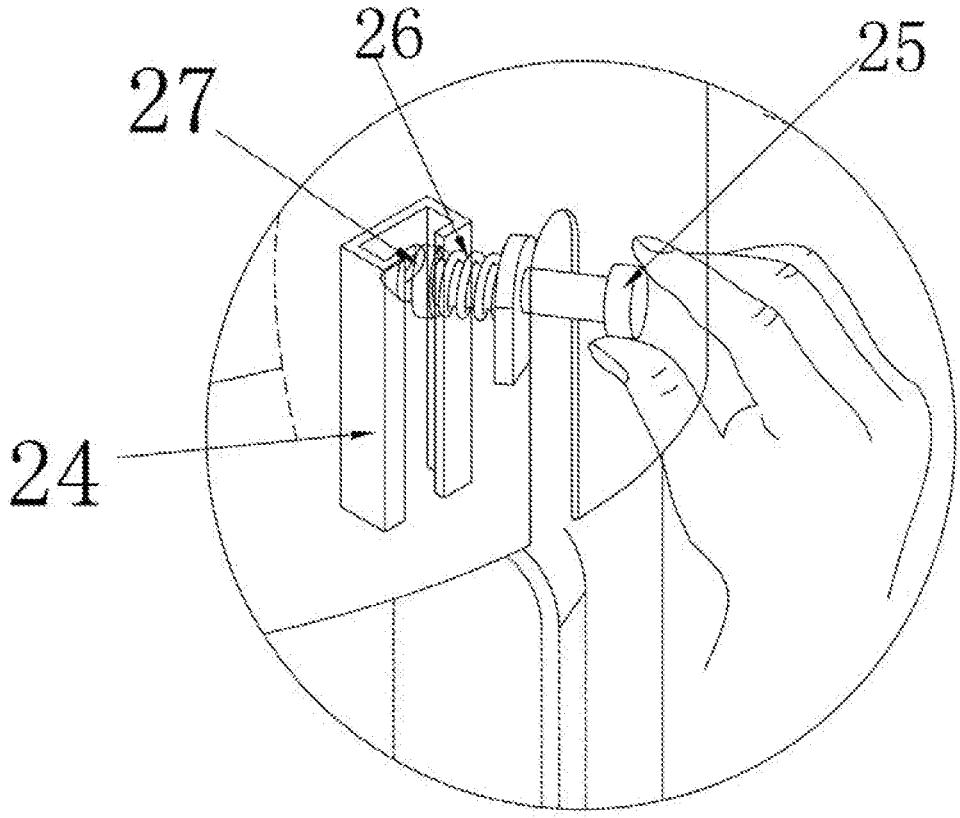
FIG. 11 shows a partial enlarged view of FIG. 10.

In this example, referring to FIG. 9, FIG. 10, and FIG. 11, the difference between this example and Example 1 is that the structures of the positioning seat and the quick mounting seat are different. The positioning seat of this example is formed by a circular positioning tube 11 extending downward along the mother lamp head 2. The bottom of the mother lamp bracket 1 forms a circular sheath 18 downward. The circular sheath 18 is located at the periphery of the circular positioning tube 11. Both sides of the circular positioning tube 11 are longitudinally provided with a track 24 with an outward opening. The track 24 is attached to the outer side of the circular positioning tube 11. A positioning hole is provided at the top of the track 24. The quick mounting seat is composed of a positioning device disposed on both sides of the top of the son lamp bracket 7 and paired with the position of the positioning hole. The positioning device is composed of a positioning post 25 and a pressing spring 26. The positioning post 25 is mounted by longitudinal positioning plates disposed on both sides of the top of the son lamp bracket 7. The positioning post 25 penetrates the longitudinal positioning plate laterally and can move forward and backward along the longitudinal positioning plate. The pressing spring 26 is fitted over the inner side end of the positioning post 25. The inner side end of the positioning post 25 is provided with a limit slider 27 for pairing into the track 24. The inner side of the limit slider 27 is a tapered post for pairing into the positioning hole. The pressing spring 26 is pressed between the limit slider 27 and the longitudinal positioning plate. The side of the circular sheath 18 is provided with an air avoiding groove that is paired with the positioning post 25 and has an opening downward. When the positioning post 25 is manually pulled outward, the tapered post is simultaneously driven to move outward, so that the tapered post is separated from the positioning hole. After the hand is released, the positioning post 25 is reset by the action of the pressing spring 26.

When it is necessary to mount the son lamp body, the son lamp body is inserted upward into the receiving chamber along the lower opening of the mother lamp cover 3, and then the positioning post 25 is aligned with the track 24, the son lamp bracket 7 is grasped by hand to continue pushing upward, and the limit slider 27 of the positioning post 25 slides upward to the track 24. During the upward sliding process, the tapered post slides into the positioning hole. At this time, the son lamp body will be stably fixed in the receiving chamber. When it is necessary to disassemble the son lamp body, the outer end of the positioning post 25 is pulled outward by hand, and the tapered post is simultaneously driven to move outward, so that the tapered post is separated from the positioning hole. When the tapered post is separated from the positioning hole, the son lamp body is separated from the mother lamp body. At this time, the son lamp body can be taken out along the lower opening of the mother lamp cover 3. The son lamp body is powered by an independent power supply and can be used independently without affecting the normal use of the mother lamp body.

The above is a further detailed description of the present invention in connection with the specific preferred examples, and the specific embodiments of the present invention are not limited to the description. A person skilled in the field to which the present invention pertains can make some simple deductions or substitutions without departing from the inventive concept and shall be regarded as the scope of protection of the present invention.

The invention claimed is:

1. An LED mother-son lamp, comprising:

a mother lamp body and a son lamp body, wherein the mother lamp body includes a mother lamp bracket, a mother lamp head and a mother lamp cover mounted on the mother lamp bracket; and a downward LED mother lamp light source mounted on the mother lamp head, and a power cord for supplying power to the LED mother lamp light source connected to the mother lamp head, wherein the mother lamp cover is mounted at the bottom of the mother lamp bracket, and the mother lamp cover extends downward to form a hollow cylindrical structure, the mother lamp head is located in the mother lamp cover, an interior of the mother lamp cover forms a receiving chamber for accommodating the son lamp body and having an opening, wherein a positioning seat for pairing and mounting the son lamp body is provided on the mother lamp head, wherein the son lamp body includes a son lamp bracket, a son lamp head and a son lamp cover mounted on the son lamp bracket, wherein the son lamp bracket is a cylindrical frame structure, and the diameter of the son lamp bracket is less than the inner diameter of the mother lamp cover, wherein the son lamp head is provided at a lower end of the son lamp bracket, and an upward LED son lamp light source is mounted on the son lamp head, wherein a battery pack for supplying power to the LED son lamp light source is provided at the bottom of the son lamp bracket, wherein the son lamp cover is provided in the son lamp bracket and extends upward to an end of the son lamp bracket along the son lamp head, and wherein the son lamp head is located in the son lamp cover and a top of the son lamp bracket is provided with a quick mounting seat for removing from the positioning seat.

2. The LED mother-son lamp of claim 1, wherein the positioning seat is formed by a circular positioning tube extending downward along the mother lamp head, and at least two L-shaped grooves are provided on the circular positioning tube, wherein the quick mounting seat includes a post paired with a number and a position of the at least two L-shaped grooves, and the post is mounted laterally to the top edge of the son lamp bracket, wherein an opening of a respective L-shaped groove extends downward, the post is engaged with the opening of the respective L-shaped groove, and the post is clamped in the respective L-shaped groove by rotating the son lamp bracket.

3. The LED mother-son lamp as claimed in claim 1, wherein the positioning seat has an inner screw seat with an opening downward and the quick mounting seat has an external threaded rod that extends upward and is paired with an inner threaded socket.

4. The LED mother-son lamp of claim 1, wherein the positioning seat is formed by a ring-shaped upper magnet disposed laterally, and the quick mounting seat has a ring-shaped lower magnet disposed laterally and magnetically fixed to the ring-shaped upper magnet.

5. The LED mother-son lamp of claim 1, wherein the positioning seat is formed by a circular positioning tube extending downward along the mother lamp head the bottom of the mother lamp bracket forms a circular sheath downward, and the circular sheath is located at a periphery of the circular positioning tube, wherein two sides of the circular positioning tube are provided with two hanging holes, the quick mounting seat has multiple elastic pieces disposed on two sides of the top of the son lamp bracket, the elastic piece is installed by a torsion spring, an inner end of a respective elastic piece is provided with a V-shaped hook for pairing into a respective hanging hole, and an outer end of the elastic piece is a pressing portion, wherein two sides of the circular sheath are provided with a pressing device corresponding to the pressing portion, and an outer end of the pressing device extends outwardly beyond the circular sheath such that when the pressing device is manually pushed inward, the pressing device drives the pressing portion to disengage the V-shaped hook from the respective hanging hole.

6. The LED mother-son lamp of claim 5, wherein the pressing device has a pressing post and a return spring fitted on an inner side of the pressing post, and an inner end of the return spring is placed on a side of the circular sheath, wherein the return spring is used to reset the pressing post, and an inner end of the pressing post extends inwardly to the pressing portion.

7. The LED mother-son lamp of claim 1, wherein the positioning seat is formed by a circular positioning tube extending downward along the mother lamp head, the bottom of the mother lamp bracket forms a circular sheath downward, and the circular sheath is located at a periphery of the circular positioning tube, wherein two sides of the circular positioning tube are longitudinally provided with a track with an outward opening, and the top of the track is provided with a positioning hole, wherein the quick mounting seat has a positioning device disposed on two sides of the top of the son lamp bracket and paired with the position of the positioning hole, the positioning device slides into the and retains into the positioning hole, an outer end of the positioning device extends outwardly beyond the circular sheath, and a side of the circular sheath is provided with an air avoiding groove that is paired with the positioning device and has an opening, such that when the positioning device is manually pulled outward, the positioning device is driven away from the positioning hole.

8. The LED mother-son lamp of claim 7, wherein the positioning device includes a positioning post and a pressing spring, the positioning post is mounted by multiple longitudinal positioning plates disposed on the two sides of the top of the son lamp bracket, the positioning post penetrates the multiple longitudinal positioning plate laterally and moves forward and backward along the longitudinal positioning plates, and the pressing spring is fitted on an inner end of the positioning post, wherein the inner end of the positioning post is provided with a limit slider for pairing into the track, an inner side of the limit slider is a tapered post for pairing into the positioning hole, and the pressing spring is pressed among the limit slider and the multiple longitudinal positioning plates, such that when the positioning post is manually pulled outward, the positioning post is reset by the pressing spring.

9. The LED mother-son lamp as claimed in claim 1, wherein the top of the son lamp bracket is mounted with a handle by a pin.

* * * * *